US007986273B2

(12) United States Patent
Tang

(10) Patent No.: US 7,986,273 B2
(45) Date of Patent: Jul. 26, 2011

(54) MULTI-BAND MONOPOLE ANTENNA WITH IMPROVED HAC PERFORMANCE

(75) Inventor: Chia-Lun Tang, Pa-Te (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 367 days.

(21) Appl. No.: 12/289,557

(22) Filed: Oct. 30, 2008

(65) Prior Publication Data

US 2010/0109953 A1 May 6, 2010

(51) Int. Cl.
*H01Q 1/38* (2006.01)

(52) U.S. Cl. ..... 343/700 MS

(58) Field of Classification Search ..... 343/700 MS, 343/702, 715, 846, 833–834
See application file for complete search history.

(56) References Cited

U.S. PATENT DOCUMENTS 5,714,937 A * 2/1998 Campana, Jr. ..... 340/573.1
6,340,952 B1 * 1/2002 Tsai et al. ..... 343/741
6,876,329 B2 * 4/2005 Milosavljevic ..... 343/700 MS
6,882,318 B2 * 4/2005 Nevermann ..... 343/702
7,405,701 B2 7/2008 Ozkar
2005/0212706 A1 * 9/2005 Ying et al. ..... 343/702
2006/0028380 A1 * 2/2006 Harano ..... 343/702
2008/0231518 A1 * 9/2008 Tsutsumi et al. ..... 343/700 MS

* cited by examiner

*Primary Examiner* — Huedung Mancuso
(74) *Attorney, Agent, or Firm* — Rosenberg, Klein & Lee

(57) ABSTRACT

A multi-band monopole antenna includes a first metal radiator and a second metal radiator extending in a same direction and arranged in parallel for exciting a high frequency band, and a detoured wire pattern connected between the feed end of the first metal radiator and the connection end of the second metal radiator for exciting a low frequency band. The detoured wire pattern has a, circuit path length longer than one half of the high frequency band $\lambda/2$ so that the phase difference on current between the feed end of the first metal radiator and the connection end of the second metal radiator is about $\pi$(180-degrees); the electric fields generated at the lower sides of the first metal radiator and the second metal radiator have approximately the same size but reversed phases and the magnetic fields have the same characteristics; when the reversed phases of electromagnetic waves excited by the first and second metal radiators reach the HAC test surface, they cause a destructive interference, thereby improving hearing aid compatibility performance of the multi-band monopole antenna.

7 Claims, 11 Drawing Sheets

MULTI-BAND MONOPOLE ANTENNA WITH IMPROVED HAC PERFORMANCE

BACKGROUND OF THE INVENTION

1. Field of the Invention

The present invention relates to monopole antenna and more particularly, to a multi-band monopole antenna, which improves hearing aid compatibility performance by means of an application of interference theory.

2. Description of the Related Art

Following fast development of wireless communication technology, many communication devices, such as cell phone, PDA and etc. employ multi-band for receiving and transmitting wireless signal. Therefore, many standards, including GSM (Global System for Mobile Communications), DCS (Distributed Control System), PCS (Personal Communication Service, AMPS (Advanced Mobile Phone System), PDC (Personal Digital Cellular), CDMA (Code Division Multiple Access), etc. are established. Under the compact requirement for handheld devices, antenna structure is required to be space-saving. In consequence, a monopole antenna is designed to be mounted inside the casing of a handheld device.

For example, U.S. Pat. No. 7,405,701, entitled "Multi-band bent monopole antenna" discloses a wireless communication device using a multi-band antenna. The multi-band antenna comprises a main antenna element and a parasitic element disposed proximate a portion of the main antenna element. Further, a selection circuit selectively applies capacitive coupling to the multi-band antenna to improve the bandwidth of a first frequency band without adversely affecting the bandwidth of a second frequency band. When the multi-band antenna operates in a low frequency band, the selection circuit fails to apply capacitive coupling to the multi-band antenna.

Further, conventional multi-band monopole antennas show a poor result in HAC (hearing aid compatibility) performance. HAC (hearing aid compatibility) regulations for antenna in cell phone have been established. ANSI (American National Standards Institute established ANSI C63.19 that establishes compatibility between hearing aids and cellular telephones. To ensure that sufficient hearing aid-compatible digital wireless phones complying with the ANSI standard are available, the FCC in 2008 set benchmark date by which digital wireless handset manufacturers and service providers had to increase the number of hearing aid-compatible digital wireless phones available to consumers to the 50 percent threshold by Feb. 18, 2008.

Similar to U.S. Pat. No. 7,405,701, FIGS. 1 and 2 show another prior art design of multi-band monopole antenna 91. According to this design, the multi-band monopole antenna 91 is installed by means of connecting its feed end 911 connected to a PC board 92. The antenna 91 has the dimension of 37 mm×18 mm×8 mm. The PC board 92 has a height 2 mm, a length 110 mm and a width 50 mm. Further, the clearance zone on the PC board 92 is 21 mm×50 mm. FIG. 3 shows the distribution of electric field and magnetic field under a low frequency band (900 MHz) of HAC testing on the multi-band monopole antenna 91. FIG. 4 shows the distribution of electric field and magnetic field under a high frequency band (1800 MHz) of HAC testing on the multi-band monopole antenna 91. From the high frequency band test result shown in FIG. 4, this prior art design of multi-band monopole antenna has room for improvement on HAC.

SUMMARY OF THE INVENTION

The present invention has been accomplished under the circumstances in view. It is therefore the main object of the present invention to provide a multi-band monopole antenna, which improves hearing aid compatibility performance by means of the application of interference theory.

To achieve this and other objects of the present invention, a multi-band monopole antenna comprises a first metal radiator and a second metal radiator extending in a same direction and arranged in parallel for exciting a high frequency band, and a detoured wire pattern connected between the feed end of the first metal radiator and the connection end of the second metal radiator for exciting a low frequency band. The detoured wire pattern has a circuit path length longer than one half of the high frequency band $\lambda/2$ so that the phase difference on current between the feed end of the first metal radiator and the connection end of the second metal radiator is about $\pi$(180-degrees). The electric fields generated at the lower sides of the first and second metal radiators have approximately the same size but reversed phases, and the magnetic fields have the same characteristics. When the reversed phases of electromagnetic waves excited by the first and second metal radiators reach the HAC test surface, they cause a destructive interference, thereby improving hearing aid compatibility performance of the multi-band monopole antenna.

When compared with the prior art designs, the multi-band monopole antenna of the invention shows no significant variation in electric and magnetic fields under the low frequency band (900 MHz), or a rise about 5.1 dB in electric field and a rise about 2.5 bD in magnetic field under the high frequency band (1800 MHz).

Further, the detoured wire pattern can be in any of a variety of configurations, for example, the detoured wire pattern can be configured to extend in horizontal or vertical.

DETAILED DESCRIPTION OF THE PREFERRED EMBODIMENT

Figure 5:
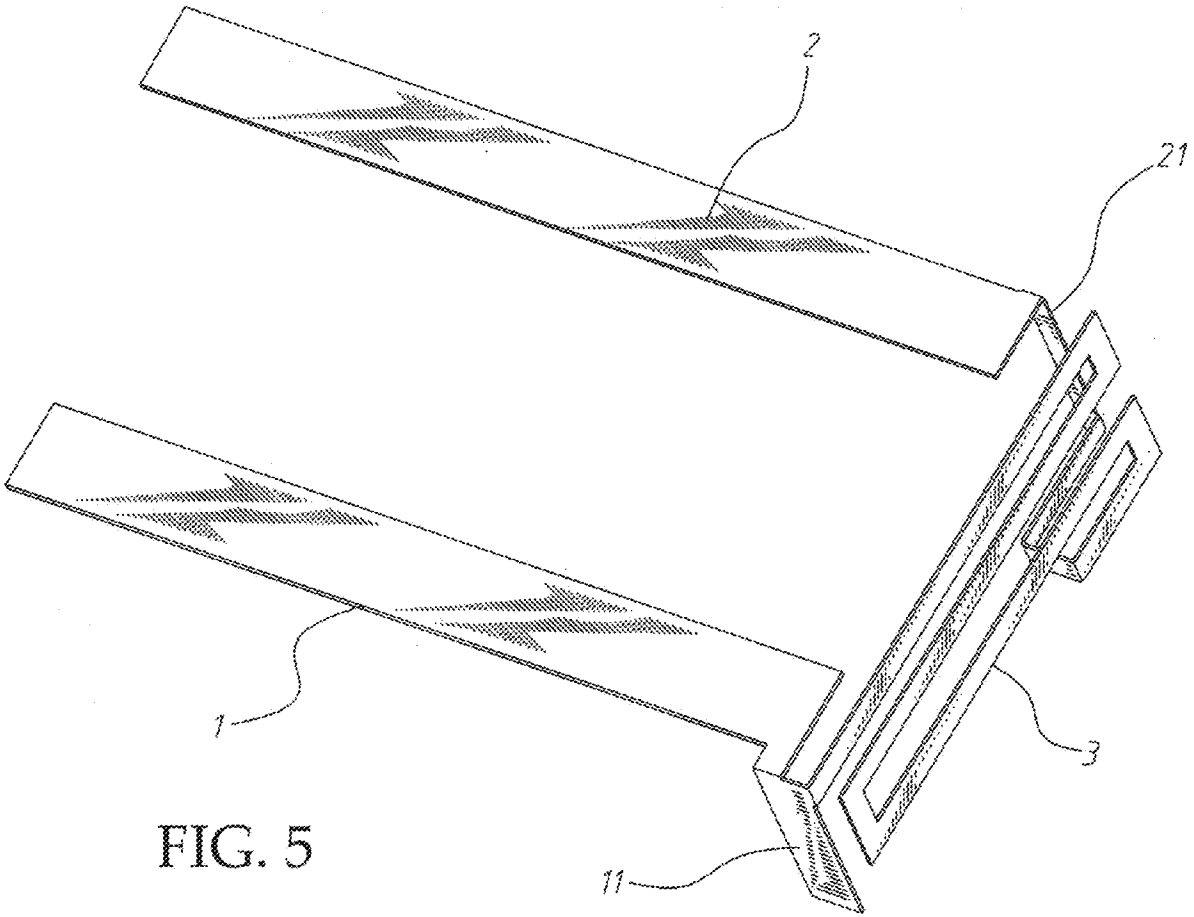
FIG. 5 is an elevational view of a multi-band monopole antenna in accordance with a first embodiment of the present invention.
Figure 6:
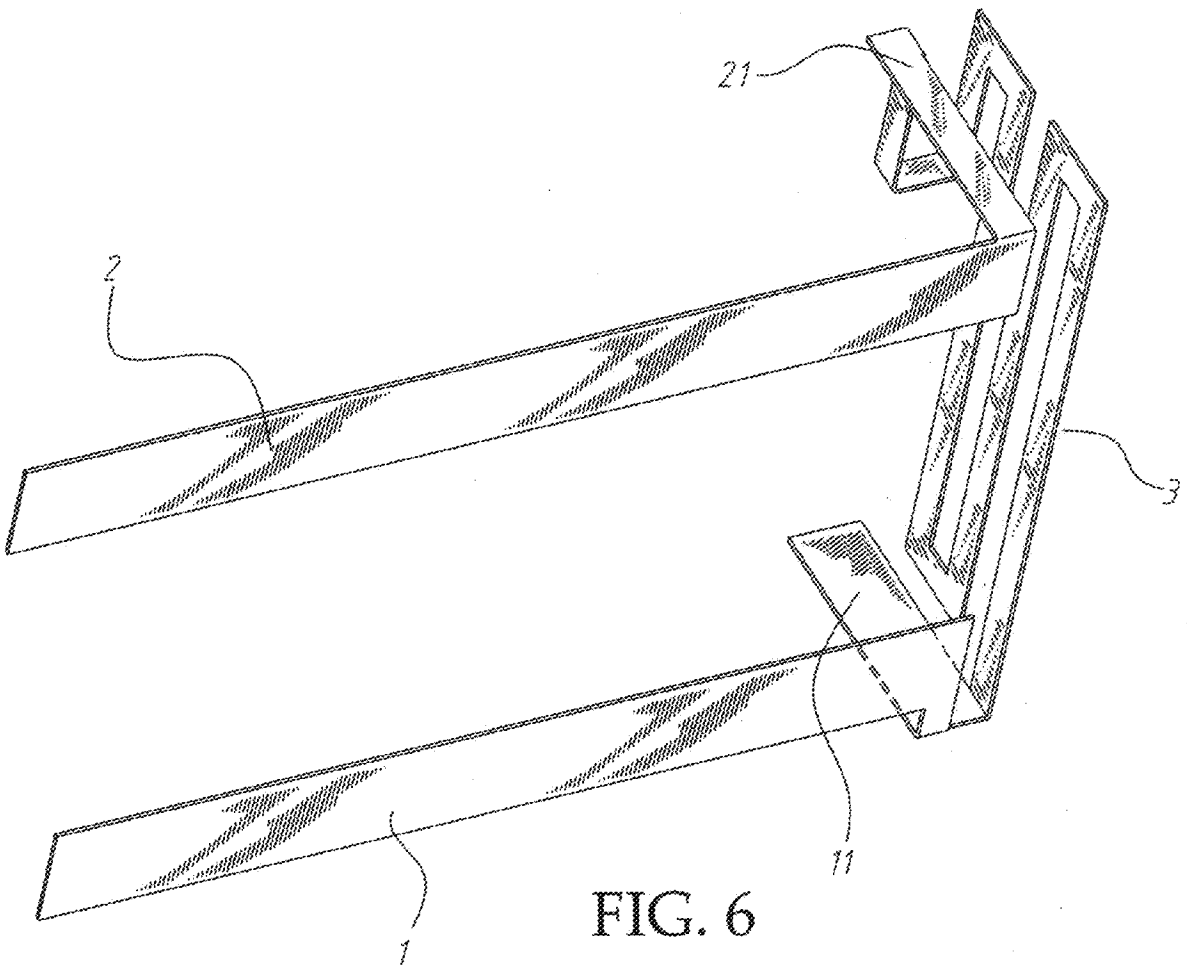
FIG. 6 corresponds to FIG. 5 when viewed from another angle.

Referring to FIGS. 5 and 6, a multi-band monopole antenna in accordance with a first embodiment of the present invention is shown comprised of a pair of first metal radiator 1 and second metal radiator 2, and a detoured wire pattern 3.

The first metal radiator 1 and the second metal radiator 2 excite a high frequency band, for example, DCS/PCS. Preferably, the first metal radiator 1 and the second metal radiator 2 are arranged in parallel and extending in one same direction. According to this embodiment, the first metal radiator 1 and the second metal radiator 2 have a rectangular shape. However, this configuration is not a limitation. They can be made in a curved shape or any other shape when kept in parallel.

The first metal radiator 1 has a feed end 11. The second metal radiator 2 has a connection end 21. The feed end 11 and the connection end 21 are disposed at the same side.

The detoured wire pattern 3 has its one end connected with the feed end 11 of the first metal radiator 1 and its other end connected with the connection end 21 of the second metal radiator 2, and therefore the detoured wire pattern 3 is disposed at one side relative to the first metal radiator 1 and the second metal radiator 2, and capable of exciting a low frequency band, for example, GSM850/GSM900. According to this embodiment, the detoured wire pattern 3 extends in horizontal.

The basic design concept of the present invention adopts destructed interference to improve HAC (hearing aid compatibility) performance of the antenna.

In the structure of the multi-band monopole antenna, the circuit path length of the detoured wire pattern 3 is slightly longer than one second of the high frequency band $\lambda/2$ so that the phase difference on current between the feed end 11 of the first metal radiator 1 and the connection end 21 of the second metal radiator 2 is about $\pi$(180-degrees). Thus, the electric fields generated at the lower sides of the first metal radiator 1 and the second metal radiator 2 have approximately the same size but reversed phases. The magnetic fields have the same characteristics. When the reversed phases of electromagnetic waves excited by the first metal radiator 1 and the second metal radiator 2 reach the HAC test surface, they cause a destructive interference. By means of this destructive interface, the invention improves the HAC (hearing aid compatibility) performance of the multi-band monopole antenna.

Further, the gap between the first metal radiator 1 and the second metal radiator 2 can effectively control the near field (magnetic field and electric field). The electric field generated by the first metal radiator 1 and the electric field generated by the second metal radiator 2 are keeping to the same direction right below the antenna, however their phases are reversed. With respect to the magnetic fields, they set off each other. The HAC test surface of the antenna is much greater than the area of the aperture of the antenna and the distances in which the electromagnetic waves excited by the first metal radiator 1 and the second metal radiator 2 reach the HAC test surface are difference result in the occurrence of destructed interference. The gap between the first metal radiator 1 and the second metal radiator 2 is basically 0.7 $\pi$~0.5 $\pi$ of the high frequency band (due to the reason of phase shift) like a super-gain antenna, however because the detoured wire pattern 3 has caused 0.5 $\pi$ phase variation, the gap between the first metal radiator 1 and the second metal radiator 2 is preferably within 0.2 $\pi$ of the high frequency band.

Properly selecting the gap between the first metal radiator 1 and the second metal radiator 2 can raise the electric field of the antenna by 5 dB and the magnetic field of the antenna by 2 dB.

With respect to the low frequency band, for example, GSM850/GSW900, it is excited by the detoured wire pattern 3; therefore its near-field effect is substantially similar to regular monopole antennas.

Based on an example of the present invention in size equivalent to the prior art multi-band monopole antennas, the HAC test result explains the innovative step of the present invention.

According to the embodiment shown in FIGS. 5 and 6, the multi-band monopole antenna has the specifications:

Dimension: 35 mm×18 mm×8 mm;

Length of first metal radiator 1: 30 mm;

Length of second metal radiator 2: 32 mm;

Length of detoured wire pattern 3: 71 mm;

Gap between first metal radiator 1 and second metal radiator 2: 11 mm.

Figure 7:
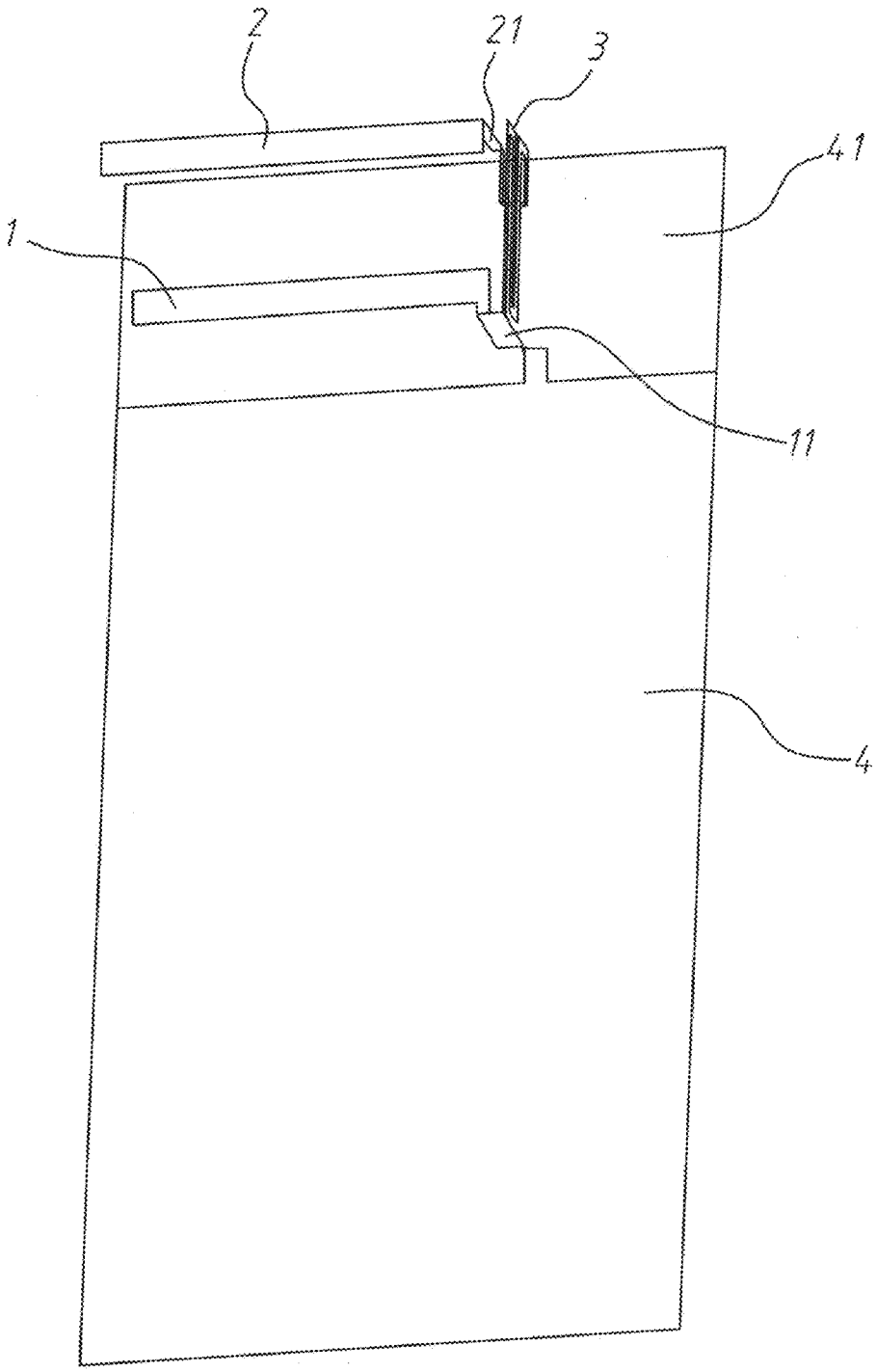
FIG. 7 is an installed view of the first embodiment of the present invention, showing the multi-band monopole antenna installed in the clearance zone on a PC board.

As shown in FIG. 7, this multi-band monopole antenna is installed in a clearance zone 41 on a PC board 4 in which the PC board 4 has a height of 2 mm, a length of 110 mm and a width of 50 mm; the size of the clearance zone 41 is 21 mm×50 mm.

Figure 8:
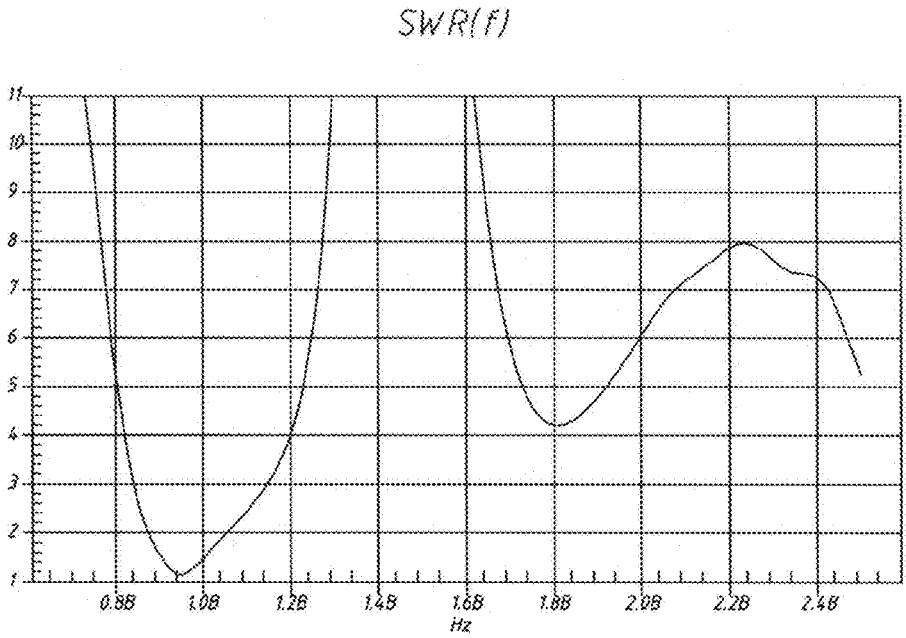
FIG. 8 is a VSWR chart obtained from the multi-band monopole antenna according to the first embodiment of the present invention.
Figure 9:
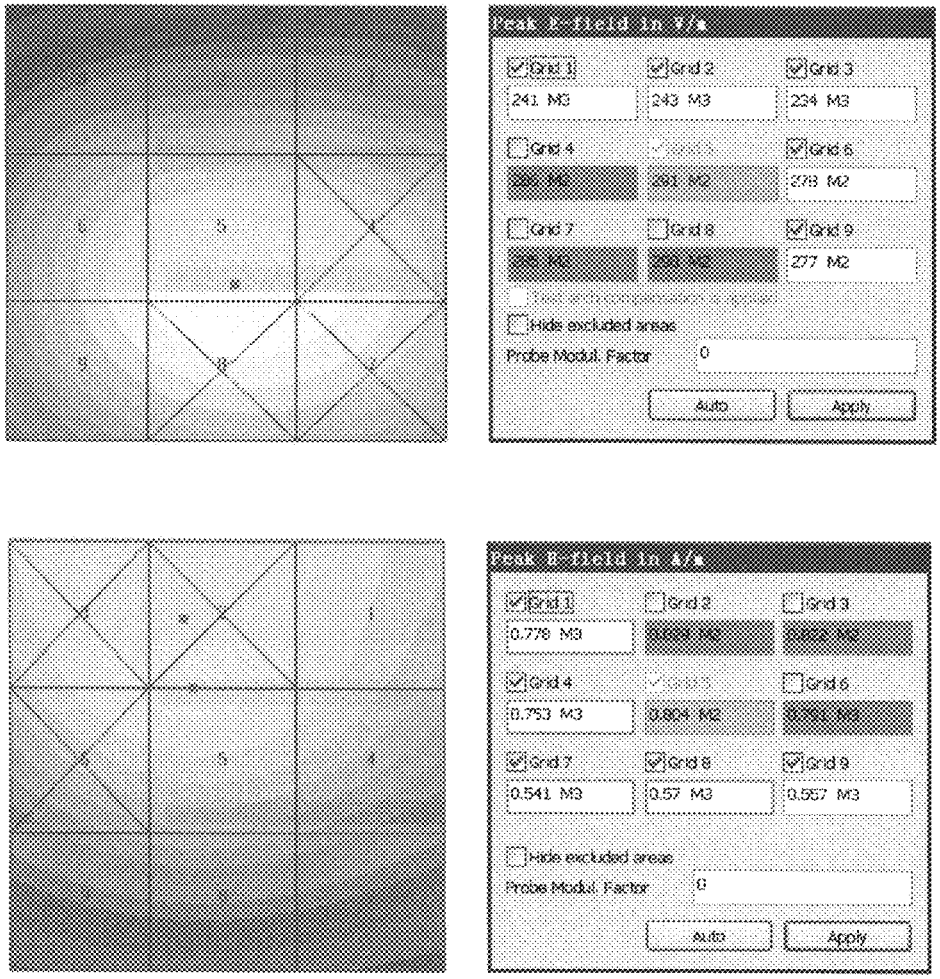
FIG. 9 illustrates the distribution of electric field and magnetic field under a low frequency band (900 MHz) of HAC testing on the multi-band monopole antenna according to the first embodiment of the present invention.
Figure 10:
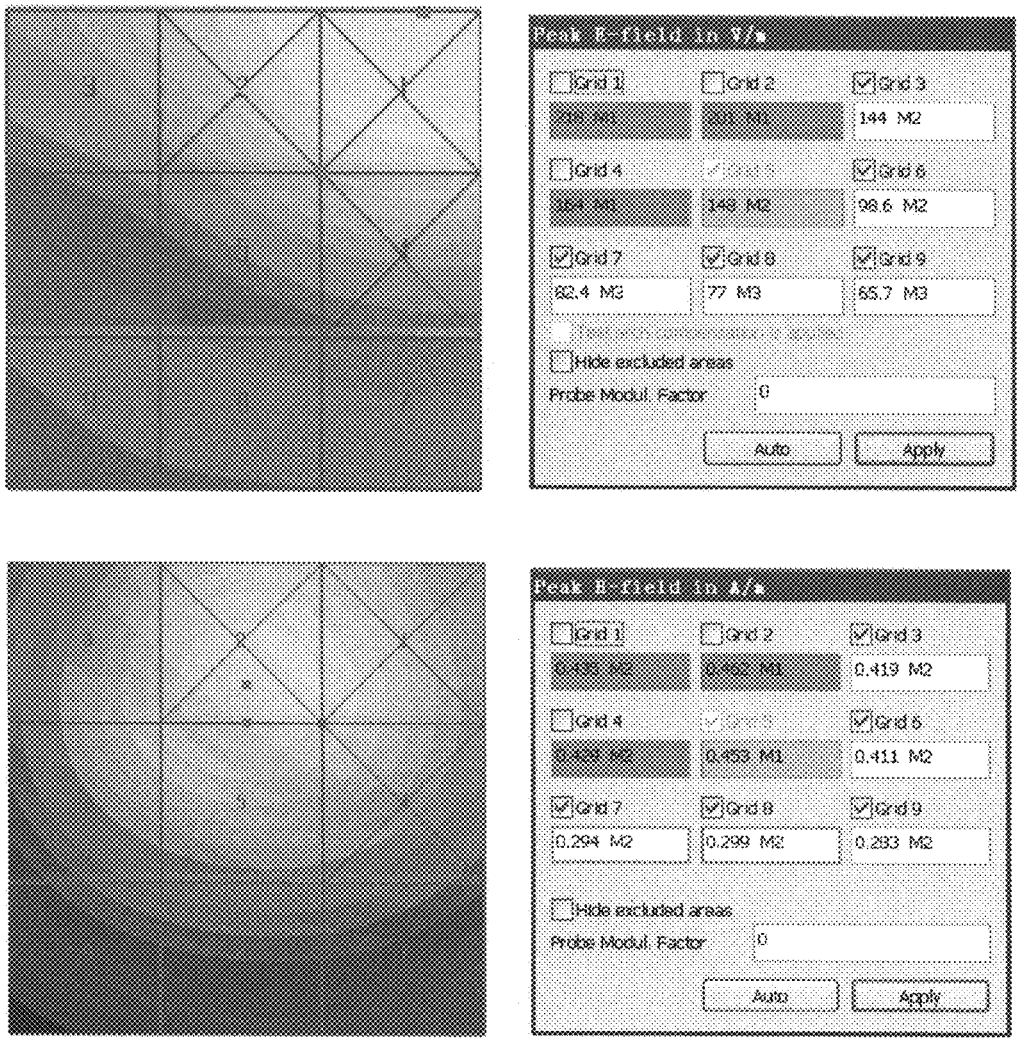
FIG. 10 illustrates the distribution of electric field and magnetic field under a high frequency band (1800 MHz) of HAC testing on the multi-band monopole antenna according to the first embodiment of the present invention.

FIG. 8 is a VSWR chart obtained from the multi-band monopole antenna of this embodiment. FIG. 9 illustrates the distribution of electric field and magnetic field under a low frequency band (900 MHz) of HAC testing on the multi-band monopole antenna of this embodiment. FIG. 10 illustrates the distribution of electric field and magnetic field under a high frequency band (1800 MHz) of HAC testing on the multi-band monopole antenna of this embodiment.

Figure 1:
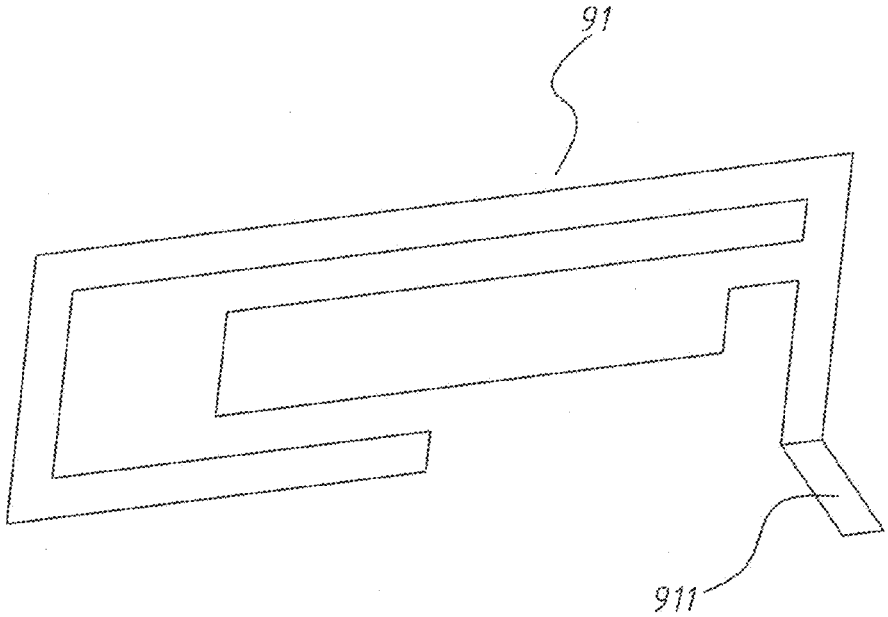
FIG. 1 Prior Art
FIG. 1 is an elevational view of a multi-band monopole antenna according to the prior art.
Figure 2:
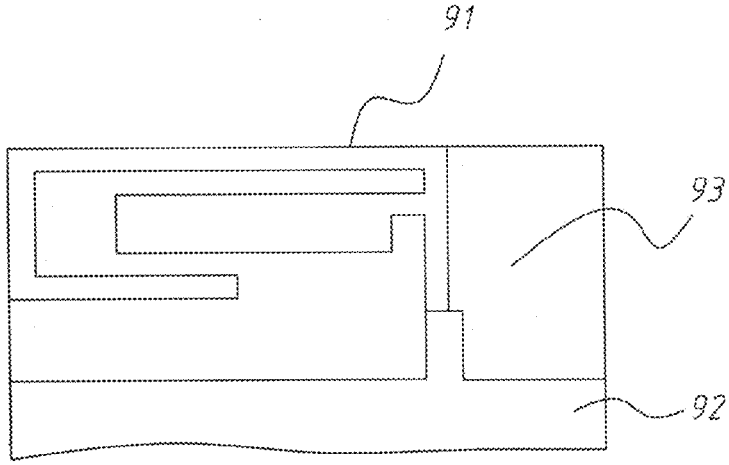
FIG. 2 Prior Art
FIG. 2 is a plain view showing the multi-band monopole antenna of FIG. 1 installed in a PC board.
Figure 3:
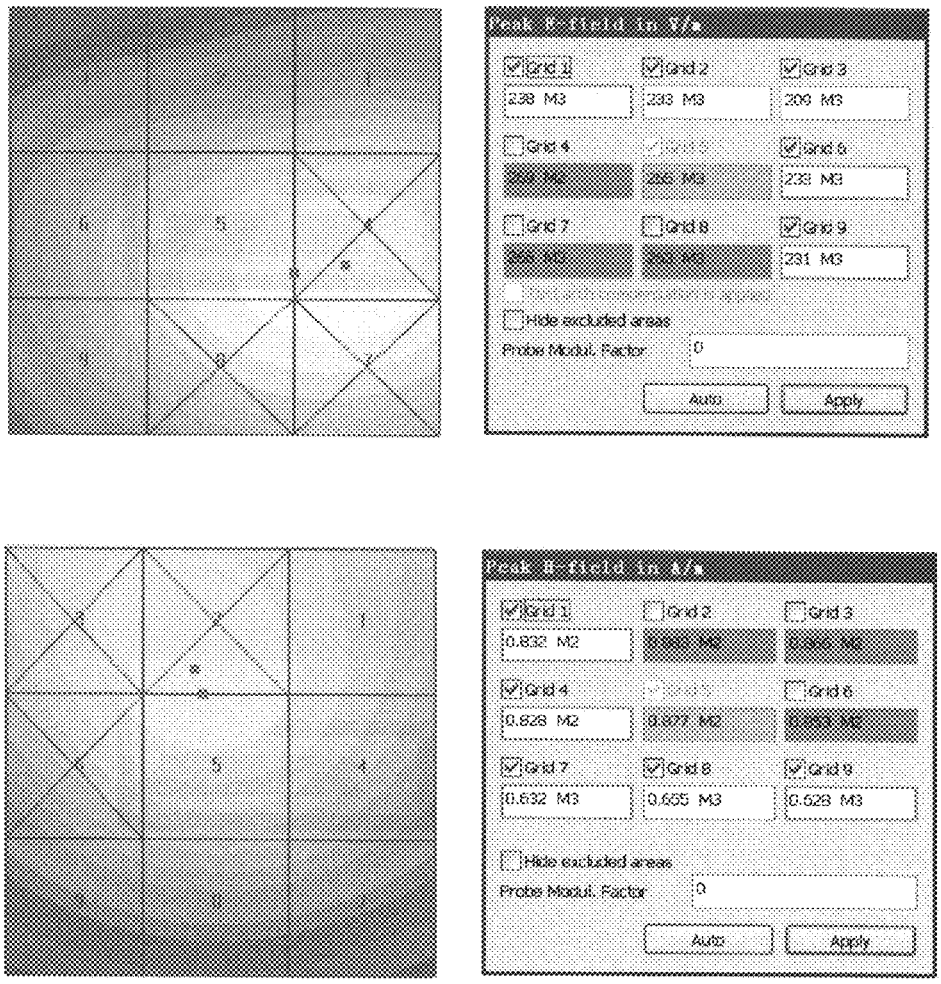
FIG. 3 Prior Art
FIG. 3 illustrates the distribution of electric field and magnetic field under a low frequency band (900 MHz) of HAC testing on the prior art multi-band monopole antenna.
Figure 4:
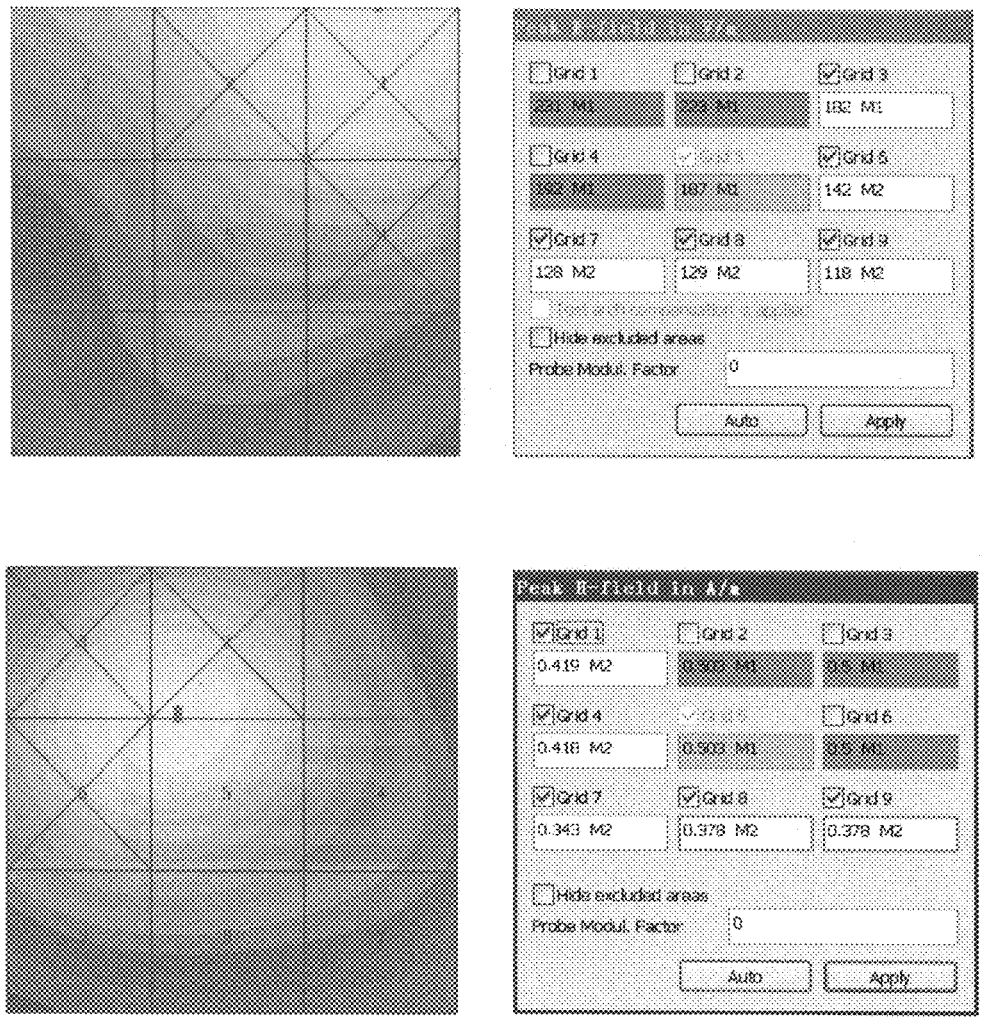
FIG. 4 Prior Art
FIG. 4 illustrates the distribution of electric field and magnetic field under a high frequency band (1800 MHz) of HAC testing on the prior art multi-band monopole antenna.

When compared the charts of FIGS. 9 and 10 with the charts of FIGS. 3 and 4, the following table is obtained:

| | | | | |
|---|---|---|---|---|
| 900 MHz | E | 283(M3)/241(M3), +1.39 dB | 233(M3)/243(M3), −0.36 dB | 209(M3)/234(M3), −0.98 dB |
| | H | 0.832(M3)/0.778(M3), +0.58 dB | 0.883(M2)/0.829(M2), −0.09 dB | 0.866(M2)/0.822(M2), +0.65 dB |
| 1800 MHz | E | 231(M1)/218(M1), +0.50 dB | 223(M1)/201(M1), +0.90 dB | 182(M1)/144(M2), +2.03 dB |
| | H | 0.419(M2)/0.435(M2), −0.33 dB | 0.503(M1)/0.462(M1), +0.74 dB | 0.5(M1)/0.419(M2), +1.54 dB |
| 900 MHz | E | 269(M2)/286(M2), −0.53 dB | 265(M3)/291(M2), −0.81 dB | 233(M3)/278(M2), −1.53 dB |
| | H | 0.828(M2)/0.753(M3), +0.82 dB | 0.877(M2)/0.804(M2), +0.75 dB | 0.853(M2)/0.791(M3), +0.66 dB |

-continued

| | | | | |
|---|---|---|---|---|
| 1800 MHz | E | 192(M1)/164(M1), +1.37 dB | 187(M1)/148(M2), +2.03 dB | 142(M2)/98.6(M2), +3.17 dB |
| | H | 0.418(M2)/0.429(M2), −0.23 dB | 0.503(M1)/0.453(M1), +0.91 dB | 0.5(M1)/0.411(M2), +1.70 dB |
| 900 MHz | E | 266(M3)/285(M3), −0.60 dB | 263(M3)/290(M2), −0.85 dB | 231(M3)/277(M2), −1.58 dB |
| | H | 0.632(M3)/0.541(M3), +1.35 dB | 0.655(M3)/0.57(M3), +1.21 dB | 0.628(M3)/0.557(M3), +1.04 dB |
| 1800 MHz | E | 128(M2)/82.4(M3), +3.83 dB | 129(M2)/77(M3), +4.48 dB | 118(M2)/65.7(M3), +5.09 dB |
| | H | 0.343(M2)/0.294(M2), +1.34 dB | 0.378(M2)/0.299(M2), +2.04 dB | 0.378(M2)/0.283(M2), +2.51 dB |

The nine-square division of the above table is same as a HAC test plane in which the format of each box is "prior art antenna/antenna of the invention, further "+" means the improved value of electric field or magnetic field, and "−" means the reduced value of electric field or magnetic field.

From the aforesaid table, we can obtain the conclusion:

1. Under 900 MHz band, the antenna of the invention and the antenna of the prior art show no significant variation in electric and magnetic fields.
2. Under 1800 MHz band, the antenna of the invention shows a rise about 5.1 dB in electric field and a rise about 2.5 bD in magnetic field when compared with the antenna of the prior art (see the right lower corner in the nine-square division of the above-mentioned table.

Figure 11:
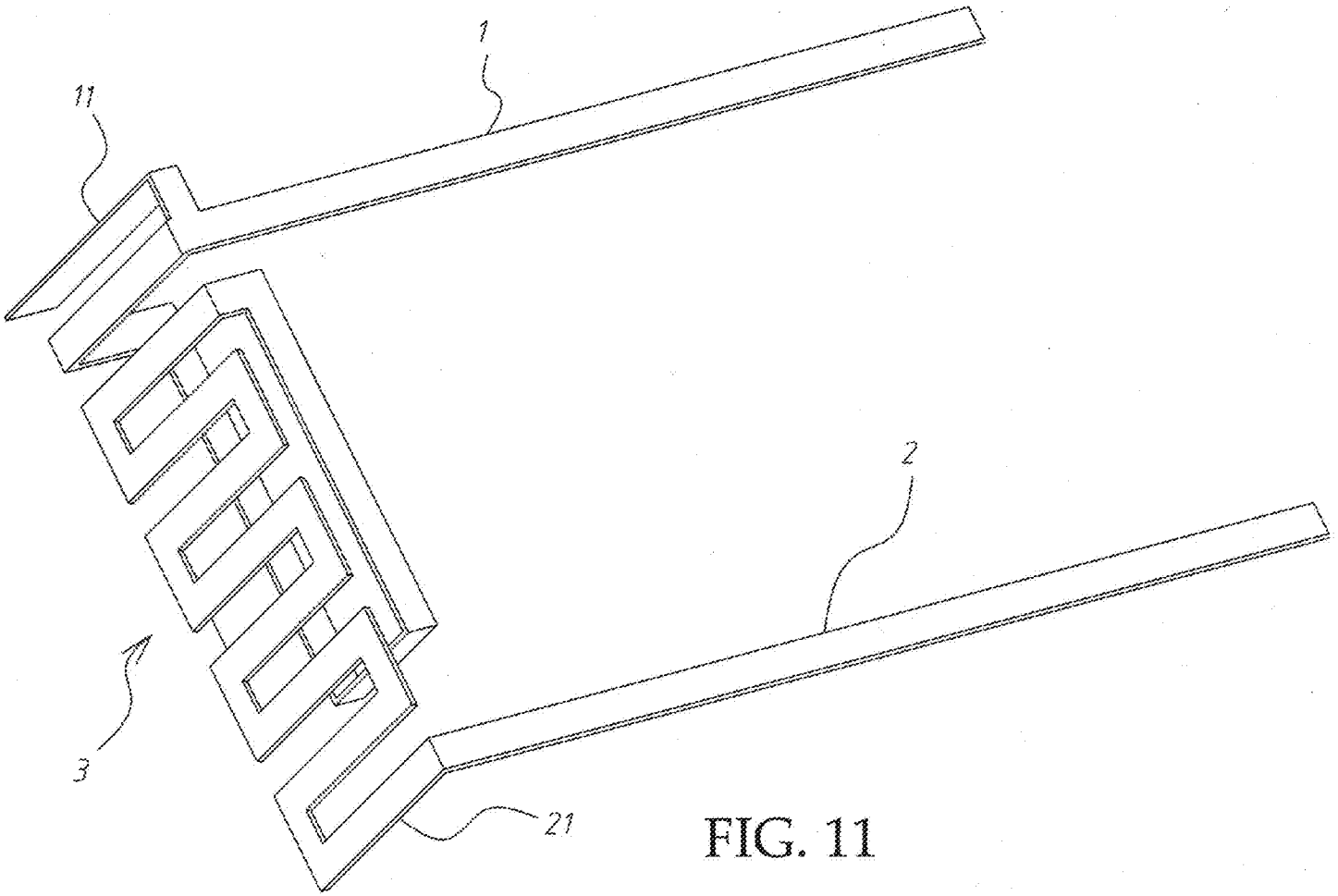
FIG. 11 is an elevational view of a multi-band monopole antenna in accordance with a second embodiment of the multi-band monopole antenna according to the present invention.
Figure 12:
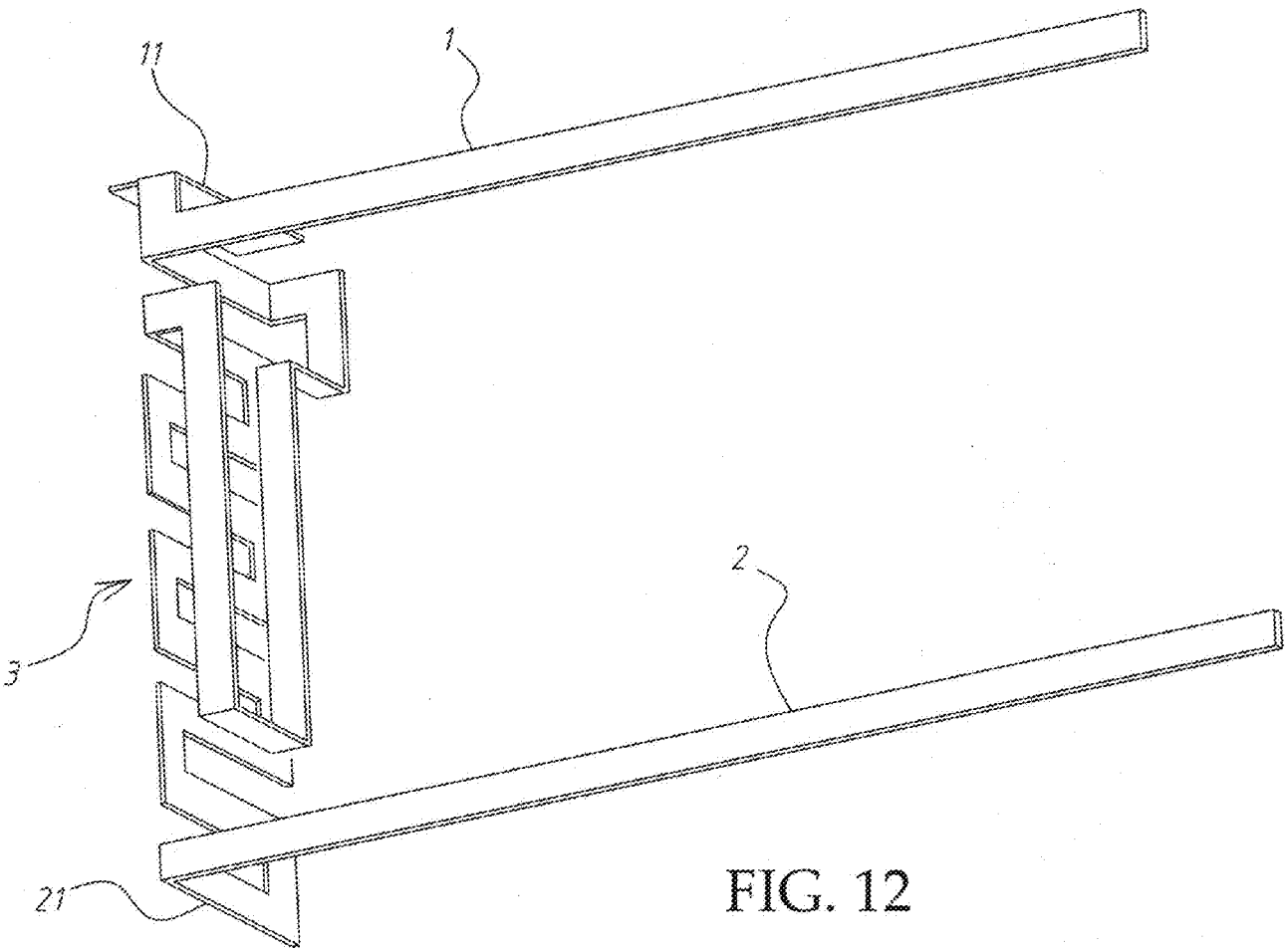
FIG. 12 corresponds to FIG. 11 when viewed from another angle.

FIGS. 11 and 12 show a multi-band monopole antenna in accordance with a second embodiment of the present invention. According to this second embodiment, the first metal radiator 1 has a feed end 11, the second metal radiator 2 has a connection end 21; the detoured wire pattern 3 has its one end connected with the feed end 11 of the first metal radiator 1 and its other end connected with the connection end 21 of the second metal radiator 2, and is adapted to excite a low frequency band. Unlike the horizontal design of the aforesaid first embodiment, the detoured wire pattern 3 according to this second embodiment extends in vertical.

In conclusion, the invention provides a multi-band monopole antenna, which improves hearing aid compatibility performance by means of an application of interference theory.

Although particular embodiments of the invention have been described in detail for purposes of illustration, various modifications and enhancements may he made without departing from the spirit and scope of the invention. For example, the first metal radiator and the second metal radiator can be curved, detoured, or made in any of a variety of other configurations. Accordingly, the invention is not to be limited except as by the appended claims.

What the invention claimed is:

1. A multi-band monopole antenna comprising:

a first metal radiator and a second metal radiator arranged in a pair and adapted to excite a high frequency band, said first metal radiator and said second metal radiator being kept apart at a distance and extending in one same direction, said first metal radiator comprising a feed end, said second metal radiator comprising a connection end, said feed end and said connection end being disposed at a same side relative to said first metal radiator and said second metal radiator; and a detoured wire pattern disposed at one side relative to said first metal radiator and said second metal radiator and adapted to excite a low frequency band, said detoured wire pattern comprising a first end connected with said feed end of said first metal radiator and a second end connected with said connection end of said second metal radiator;

wherein said detoured wire pattern has a circuit path length longer than one half of said high frequency band $\lambda/2$ so that the phase difference on current between the feed end of said first metal radiator and the connection end of said second metal radiator is about $\pi$; when the reversed phases of electromagnetic waves excited by said first metal radiator and said second metal radiator reach the HAC test surface, they cause a destructive interference, thereby improving hearing aid compatibility performance of the multi-band monopole antenna.

2. The multi-band monopole antenna as claimed in claim 1, wherein said first metal radiator and said second metal radiator are arranged in parallel.

3. The multi-band monopole antenna as claimed in claim 1, wherein the gap between said first metal radiator and said second metal radiator is within 0.2 $\lambda$ of said high frequency band.

4. The multi-band monopole antenna as claimed in claim 1, wherein the size of the multi-band monopole antenna is 35 mm×18 mm×8 mm; the length of said first metal radiator is 30 mm; the length of said second metal radiator is 32 mm; the length of said detoured wire pattern is 71 mm; the gap between said first metal radiator and said second metal radiator is 11 mm.

5. The multi-band monopole antenna as claimed in claim 1, which is installed in a clearance zone on a printed circuit board, said printed circuit board having the size of 2 mm height, 110 mm length and 50 mm width, said clearance zone having the size of 21 mm×50 mm.

6. The multi-band monopole antenna as claimed in claim 1, wherein said detoured wire pattern extends in horizontal.

7. The multi-band monopole antenna as claimed in claim 1, wherein said detoured wire pattern extends in vertical.

* * * * *